US010028593B1

(12) United States Patent
Mathews, Jr.

(10) Patent No.: US 10,028,593 B1
(45) Date of Patent: Jul. 24, 2018

(54) INFANT WALKER SYSTEM

(71) Applicant: Micheal Mathews, Jr., Cedar Hill, TX (US)

(72) Inventor: Micheal Mathews, Jr., Cedar Hill, TX (US)

( * ) Notice: Subject to any disclaimer, the term of this patent is extended or adjusted under 35 U.S.C. 154(b) by 293 days.

(21) Appl. No.: 14/932,247

(22) Filed: Nov. 4, 2015

Related U.S. Application Data

(60) Provisional application No. 62/075,081, filed on Nov. 4, 2014.

(51) Int. Cl.
*A47D 13/04* (2006.01)
*B61B 3/00* (2006.01)

(52) U.S. Cl.
CPC ..... *A47D 13/046* (2013.01); *B61B 3/00* (2013.01)

(58) Field of Classification Search
CPC .... A47D 13/04; A47D 13/043; A47D 13/046; A47D 13/06; A47D 13/105; A47D 13/107; A61H 3/008; A63H 33/006
See application file for complete search history.

(56) References Cited

U.S. PATENT DOCUMENTS 58,510 A * 10/1866 Thompson ..... A63B 69/0064 182/36
178,680 A * 6/1876 Shaw ..... A47D 13/107 297/275
1,072,959 A * 9/1913 Kincannon ..... A47C 3/28 24/697.1
1,297,800 A * 3/1919 Cranford ..... A47D 13/043 182/36
1,419,890 A * 6/1922 Noel, Sr. ..... A47D 13/04 482/51
1,548,535 A * 8/1925 Lydecker ..... A63G 9/04 104/81
1,642,184 A * 9/1927 Urso ..... A47D 13/04 482/41
2,478,004 A * 8/1949 Newell ..... A47D 13/04 182/3
2,766,464 A * 10/1956 Savi ..... A47D 3/005 297/136
3,204,954 A * 9/1965 Scannell ..... A61H 3/008 482/69
3,990,667 A * 11/1976 Tomalinas, Jr. ..... A47D 13/105 248/370
4,603,828 A * 8/1986 Farley, Jr. ..... A63H 33/006 211/123

(Continued)

*Primary Examiner* — Zachary L Kuhfuss
(74) *Attorney, Agent, or Firm* — Eldredge Law Firm, LLC; Richard Eldredge

(57) ABSTRACT

A infant walker system includes a frame with a first top rail; a second top rail; a first leg attached to the first top rail and configured to elevate the first top rail at a distance relative to a ground surface; and a second leg attached to the second top rail and configured to elevate the second top rail at a distance relative to the ground surface. The system also includes a harness secured to the first top rail and the second top rail, the harness being configured to secure an infant at a predetermined height relative to the ground surface; a first sliding joint slidingly engaged with the first top rail; a second sliding joint slidingly engaged with the second top rail; a first strap attached to the harness and to the first sliding joint; and a second strap attached to the harness and to the second sliding joint.

18 Claims, 4 Drawing Sheets

(56) References Cited

U.S. PATENT DOCUMENTS

| | | | | | |
|---|---|---|---|---|---|
| 4,621,804 | A * | 11/1986 | Mueller | A47D 13/043 | 135/67 |
| 4,844,452 | A * | 7/1989 | Tomosky | A47D 13/043 | 297/274 |
| 4,948,120 | A * | 8/1990 | Krueger | A47D 13/105 | 297/274 |
| 5,458,550 | A * | 10/1995 | Braim | A47D 13/04 | 297/274 |
| 5,522,782 | A * | 6/1996 | Kurtin | A47D 13/04 | 280/87.051 |
| 5,667,461 | A * | 9/1997 | Hall | A61H 1/0229 | 472/15 |
| 6,648,411 | B2 * | 11/2003 | Julien | A47D 13/105 | 297/273 |
| 6,669,605 | B2 * | 12/2003 | Scates | A47D 13/04 | 482/69 |
| 6,890,288 | B2 * | 5/2005 | Bingham | A47D 13/046 | 482/69 |
| 8,784,284 | B1 * | 7/2014 | Smith | A47D 13/08 | 482/121 |
| 9,204,733 | B2 * | 12/2015 | Welch | A47D 13/107 | |
| 9,302,146 | B1 * | 4/2016 | Wien | A47D 13/107 | |
| 2002/0193209 | A1 * | 12/2002 | Scates | A63B 22/0605 | 482/63 |
| 2009/0062082 | A1 * | 3/2009 | Spencer-Kramer | A47D 13/04 | 482/66 |
| 2014/0265457 | A1 * | 9/2014 | Welch | A47D 13/043 | 297/5 |

* cited by examiner

INFANT WALKER SYSTEM

BACKGROUND

1. Field of the Invention

The present invention relates generally to infant walkers, activity centers, and entertainers.

2. Description of Related Art

Infant walkers are well known in the art and are effective means to assist a child in the process of learning how to walk. For example, FIG. 1 depicts a conventional infant walker 101 having a frame 103 that securely holds a seat 105 a distance relative to the ground surface 109. Walker 101 further includes a plurality of wheels pivotally engaged to the frame 103 and configured to allow movement of the walker during use. Thus, during use, the infant is placed in seat 105 and moves the walker 101 along the ground surface 109 with the infant legs.

A common disadvantage associated with walker 101 is the limited use and lack of adequately teaching the infant natural walking on the ground surface. For example, walker 101 teaches the infant leg muscle movement, but is limited on balance and other movements necessary to help a child to walk. In addition, the infant walkers pose safety hazards due to wheels that increase the range speed and the infant walkers allow infants to access dangerous areas.

Although great strides have been made in the area of infant walkers, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
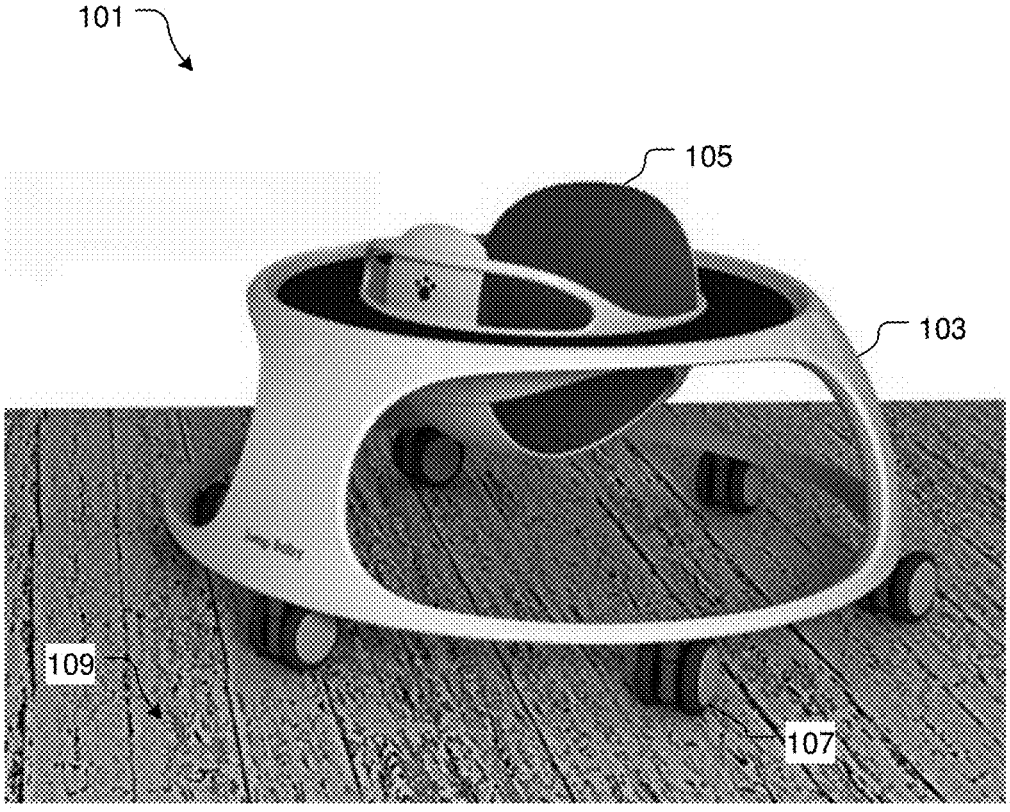
FIG. 1 (Prior Art)
FIG. 1 is an oblique view of a conventional infant walker.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional infants walker systems. Specifically, the system of the present application is configured to provide rapid and effective means to assist the infant in the process of learning how to walk. The system includes an infant harness that slidingly engages with one or more horizontal rails, which in turn allows the infant to walk along a predetermined path while being partially supported with the harness. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
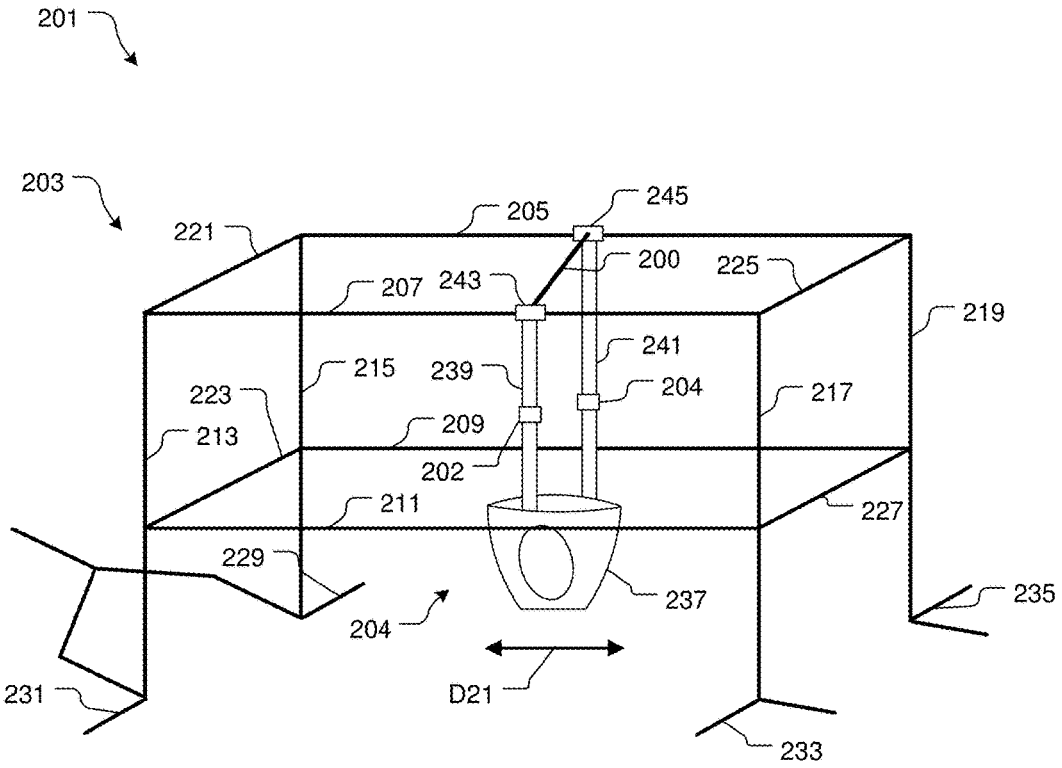
FIG. 2 is an oblique view of an infant walker system in accordance with a preferred embodiment of the present application.

Referring now to the drawings wherein like reference characters identify corresponding or similar elements throughout the several views, FIG. 2 depicts a simplified oblique view of an infant walker system 201 in accordance with a preferred embodiment of the present application. It will be appreciated that the system 201 overcomes one or more of the above-listed problems commonly associated with the conventional infant walkers. It will be appreciate that the features discussed herein could also be used with persons at activity centers as a way to strengthen the infant's legs.

In the contemplated embodiment, system 201 includes one or more of a frame 203 configured to support an infant harness 204. During use, the infant harness slidingly engages with one or more rails of the frame, thus allowing the infant strapped therein (not shown) to traverse along a predetermined path created by frame 203.

Frame 203 preferably includes two top rails 205, 207 and two hand rails 209, 211 that run relatively parallel to each other. The top rails and the hand rails are supported in position at a distance relative to the ground surface with four vertical rails 213, 215, 217, and 219. Additional rigidity and support is provided with support rails 221, 223, 225, and 227. It is also contemplated using eight footings 229, 231, 233, and 235 attached to the vertical rails. It should be understood that more or less rails can be used in alternative embodiments.

Infant harness 204 includes a seat 237 that is suspended in position via two straps 239, 241 attached to two sliding members 243, 245 that attach to respective straps 239, 241 and are configured to slidingly engage with respective rails 207, 205. In the contemplated embodiment, a bridge 200 can be used to join the sliding members together to add additional support.

During use, the infant is placed in the harness and the sliding members allow the infant to move along the path defined by the frame, as indicated by arrow D21. The harness maintains the infant at a distance relative to the ground surface, thereby allowing the infant to move the legs as if the infant were walking. In the contemplated embodiment, the straps 239, 241 include respective adjustment devices 202, 204 configured to allow the user to adjust the overall length of the straps, which in turn retains the infant at a desired distance from the ground surface.

It will be appreciated that alternative embodiments could include more or less rails. For example, in one contemplated embodiment, the harness could be attached directly to the hand rails, thereby eliminating the need for the top rails.

Figure 3:
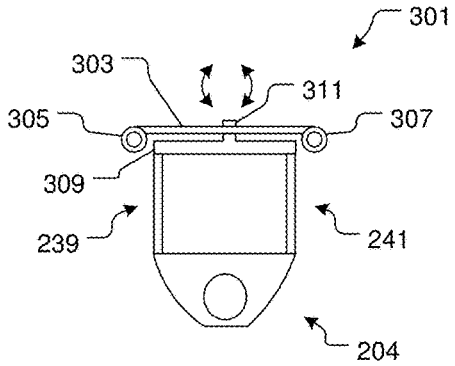
FIG. 3 is an oblique view of a harness in accordance with an alternative embodiment of the present application.

In FIG. 3, an oblique view of an alternative embodiment is shown. System 301 is substantially similar in form and function to system 201 and hereby incorporates one or more of the features discussed herein. In this embodiment, it is also contemplated using a motivator 303 or 305 configured to motivate the infant to move in direction D31. For example, a display or toy could be used to motivate walking movement.

In FIG. 3, system 301 includes a bridge 303 having sliding members 305, 307 at opposing ends and configured to engage with rails 205, 207. During use, the bridge 303 slides in direction D21 along rails 205, 207 via sliding members 305, 307. The bridge is configured to add additional support and rigidity to the frame 203 and is configured to support harness 204 via a harness yoke 309 pivotally attached to bridge 303. As depicted, the straps 239, 241 are secured to yoke 309 at opposing ends. Also, as indicated by the arrows, the yoke pivotally attaches to the bridge 303 for additional freedom of movement.

Figure 4:
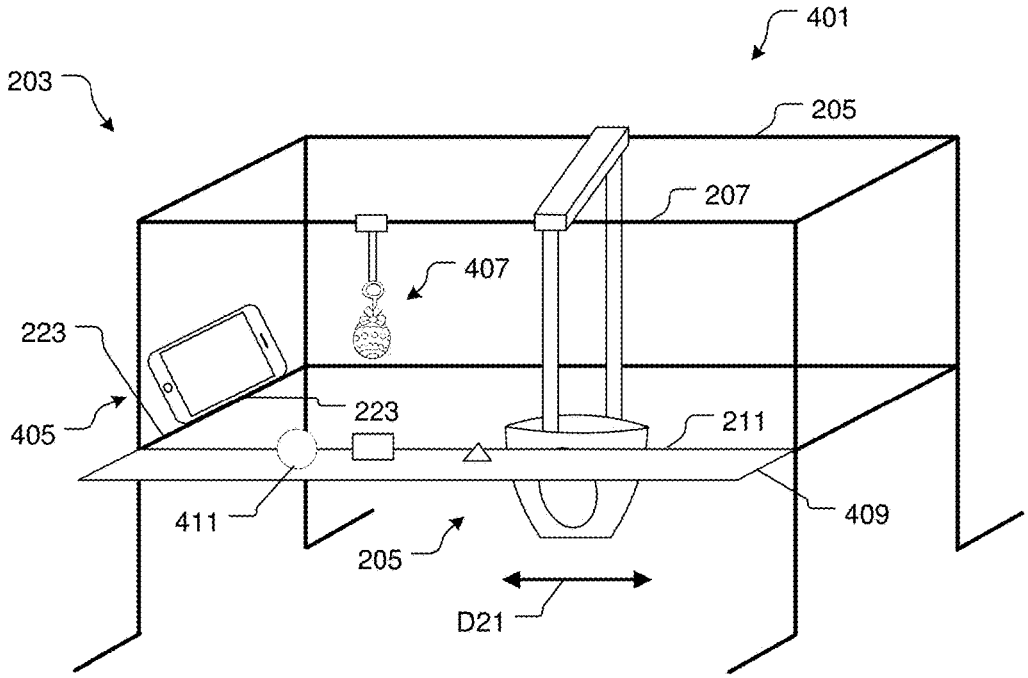
FIG. 4 is an oblique view of an infant walker system in accordance with an alternative embodiment of the present application.

In FIG. 4, an oblique view of a rail system is shown in accordance with an alternative embodiment of the present application. It will be appreciated that the features of systems 201, 301 are hereby incorporated in system 401. Accordingly, system 401 is substantially similar in form and function to the systems discussed herein. In this embodiment, system 401 is provided with one or more different types of motivators configured to motivate the infant to travel along the railing.

In the contemplated embodiment, system 401 includes one or more of a display 405 secured to rail 223, a toy 407 slidingly engaged to rail 207, a table 409 secured to and extending from rail 211 and configured to allow placement of toys 411 thereon.

It will be appreciated that the rail systems discussed herein include the feature of being portable and adjustable. Thus, the overall length, width, and height of the frame is adjustable to accommodate the infant size. One of the unique features believed characteristic of the present application is the ability to removably attach the various rails together via one or more attachment devices and to adjust the length of the rails, as depicted in FIGS. 5A and 5B.

Figure 5A:
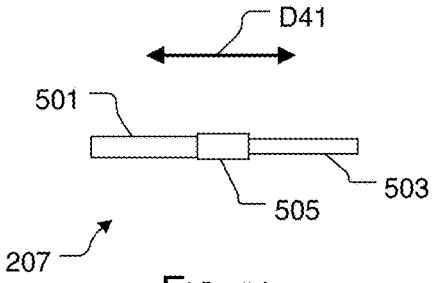
FIGS. 5A and 5B are side views of an adjustable rail in accordance with a preferred embodiment of the present application.
Figure 5B:
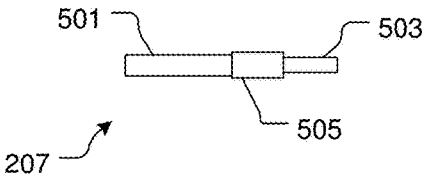

In the exemplary embodiment shown in FIGS. 5A and 5B, the rail 207 includes a first shaft member 501 configured to telescopically engage with a second shaft member 503 via a locking device 505. This feature is hereby incorporated in all rails of the systems discussed above, although not shown explicitly in each figure.

Figure 6:
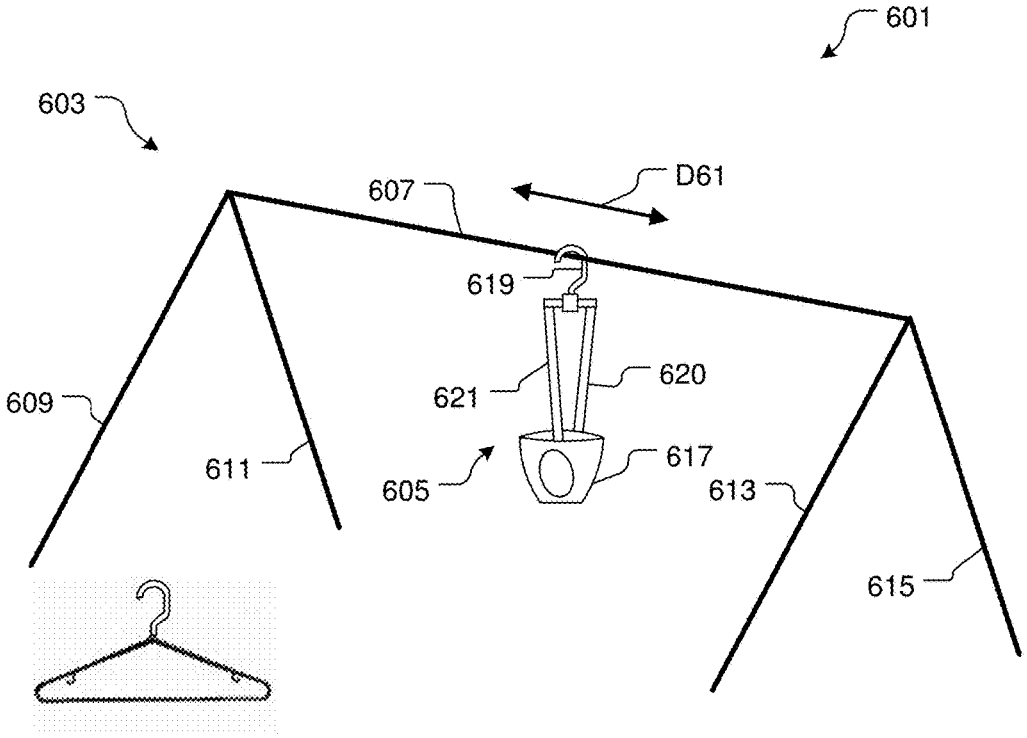
FIG. 6 is an oblique view of an infant walker system in accordance with an alternative embodiment of the present application.

Referring now to FIG. 6, an oblique view of a system 601 is shown in accordance with an alternative embodiment of the present application. System 601 is substantially similar in form and function to the systems discussed herein.

System 601 includes a frame 603 having an elongated center rail 607 with a first pair of legs 609, 611 secured thereto at one end a second pair of legs 613, 615 secured to center rail 607 at an opposing end. The center rail 607 is configured to retain an infant harness 605 at a height relative to the ground surface and engages with a sliding joint 619 configured to allow sliding movement of the harness 605 relative to the center rail, as indicated by arrow D61.

Harness 605 includes a saddle 617 having openings to allows the infant to extend legs therethrough. As depicted, the saddle 617 includes two straps 620, 621 attached thereto and extending to joint 619.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An infant walker system, comprising:

a frame having:

a first top rail;

a second top rail, the second top rail is spaced apart from the first top rail and configured to run parallel to the first top rail;

a first leg attached to the first top rail and configured to elevate the first top rail at a distance relative to a ground surface; and a second leg attached to the second top rail and configured to elevate the second top rail at a distance relative to the ground surface;

a first hand rail rigidly attached to the first leg and configured to run parallel to the first top rail;

a second hand rail rigidly attached to the first leg and configured to run parallel to the second top rail;

a table secured to and extending from the first hand rail, the table is configured to support an object thereon;

a harness secured to the first top rail and the second top rail, the harness being configured to secure an infant at a predetermined height relative to the ground surface;

a first sliding joint slidingly engaged with the first top rail;

a second sliding joint slidingly engaged with the second top rail;

a first strap attached to the harness and to the first sliding joint; and a second strap attached to the harness and to the second sliding joint.

2. The system of claim 1, further comprising:

a bridge rigidly secured to the first sliding joint and to the second sliding joint.

3. The system of claim 1, further comprising:

a motivator device secured to the frame;

wherein the motivator device is configured to stimulate movement of the infant.

4. The system of claim 3, wherein the motivator device is a toy that slidingly engages with the first top rail.

5. The system of claim 1, wherein the frame is adjustable.

6. The system of claim 5, the first top rail, comprising:

a first member telescopically engaged with a second member and retained in position via a locking device.

7. The system of claim 1, wherein the first strap and the second strap are adjustable in length.

8. An infant walker system, comprising:

a frame having:

a first top rail;

a second top rail;

a first leg attached to the first top rail and configured to elevate the first top rail at a distance relative to a ground surface; and a second leg attached to the second top rail and configured to elevate the second top rail at a distance relative to the ground surface;

a first hand rail rigidly attached to the first leg and configured to run parallel to the first top rail;

a second hand rail rigidly attached to the first leg and configured to run parallel to the second top rail;

a table secured to and extending from the first hand rail, the table is configured to support an object thereon;

a harness secured to the first top rail and the second top rail, the harness being configured to secure an infant at a predetermined height relative to the ground surface;

a first sliding joint slidingly engaged with the first top rail;

a second sliding joint slidingly engaged with the second top rail;

a bridge rigidly attached to the first sliding joint and to the second sliding joint;

a yoke pivotally attached to the bridge;

a first strap attached to the harness and to the yoke; and a second strap attached to the harness and to the yoke.

9. The system of claim 8, further comprising:

a motivator device secured to the frame;

wherein the motivator device is configured to stimulate movement of the infant.

10. The system of claim 9, wherein the motivator device is a toy that slidingly engages with the first top rail.

11. The system of claim 8, wherein the frame is adjustable.

12. The system of claim 11, the first top rail, comprising:

a first member telescopically engaged with a second member and retained in position via a locking device.

13. The system of claim 8, wherein the first strap and the second strap are adjustable in length.

14. An infant walker system, comprising:

a frame having:

an elongated center rail;

a first pair of legs extending from the elongated center rail at a first end and a second pair of legs extending from the elongated center rail at a second end opposing the first end;

a first hand rail rigidly attached to the first leg and configured to run parallel to the first top rail;

a second hand rail rigidly attached to the first leg and configured to run parallel to the second top rail;

a table secured to and extending from the first hand rail, the table is configured to support an object thereon;

a harness secured to the center rail, the harness being configured to secure an infant at a predetermined height relative to the ground surface;

a sliding joint slidingly engaged with the center rail;

a first strap attached to the harness and to the sliding joint; and a second strap attached to the harness and to the sliding joint.

15. The system of claim 14, further comprising:

a motivator device secured to the frame;

wherein the motivator device is configured to stimulate movement of the infant.

16. The system of claim 14, wherein the frame is adjustable.

17. The system of claim 14, the center rail, comprising:

a first member telescopically engaged with a second member and retained in position via a locking device.

18. The system of claim 14, wherein the first strap and the second strap are adjustable in length.

* * * * *